US007712618B2

(12) United States Patent
Barre et al.

(10) Patent No.: US 7,712,618 B2
(45) Date of Patent: May 11, 2010

(54) CONTAINER CAP WITH LOCKING/UNLOCKING MECHANISM THAT PROPELS LID TO OPEN POSITION

(75) Inventors: Bertrand Barre, La Peyrouse (FR); Xavier Gibert, Chossieu (FR); Francis Lepage, Dommartin (FR)

(73) Assignee: The Zebra Company, Limonest (FR)

( * ) Notice: Subject to any disclaimer, the term of this patent is extended or adjusted under 35 U.S.C. 154(b) by 901 days.

(21) Appl. No.: 11/184,912

(22) Filed: Jul. 20, 2005

(65) Prior Publication Data

US 2006/0016776 A1 Jan. 26, 2006

Related U.S. Application Data

(60) Provisional application No. 60/589,005, filed on Jul. 20, 2004.

(51) Int. Cl.
*B65D 39/00* (2006.01)
*B65D 47/00* (2006.01)
*B65D 51/04* (2006.01)

(52) U.S. Cl. ..... 215/237; 215/354; 220/835; 220/254.3; 220/324; 222/556; 222/563

(58) Field of Classification Search ..... 215/235, 215/237, 354, 245; 222/546, 556, 153.04, 222/153.13, 153.14; 220/264, 835, 836, 220/840, 841, 281, 254.3, 254.7
See application file for complete search history.

(56) References Cited

U.S. PATENT DOCUMENTS

| | | | | |
|---|---|---|---|---|
| 4,821,898 | A * | 4/1989 | Smalley | 215/216 |
| 5,938,087 | A * | 8/1999 | Randall | 222/547 |
| 6,634,060 | B1 * | 10/2003 | Lagler et al. | 16/225 |
| 2002/0036207 | A1 * | 3/2002 | Ohuo et al. | 220/830 |
| 2003/0136783 | A1 * | 7/2003 | Hatsumoto et al. | 220/254.3 |

FOREIGN PATENT DOCUMENTS

| | | | |
|---|---|---|---|
| EP | 0 547 978 | A1 | 6/1993 |
| EP | 1 129 959 | A2 | 9/2001 |
| FR | 2 855 815 | A1 | 12/2004 |

* cited by examiner

*Primary Examiner*—Robin Hylton
(74) *Attorney, Agent, or Firm*—Oliff & Berridge, PLC

(57) ABSTRACT

A cap intended to be mounted on a container includes a base, a lid with a stopper, structure articulating the lid with respect to the base, with a hinge, a structure for locking the lid on the base, and structure for unlocking the locking structure.

The lid is arranged to resist any relative movement between the lid and the base and to store mechanical energy by plastic deformation of at least one of the lid and the base and the unlocking structure is arranged in the form of a detent allowing the stored mechanical energy to be released in order to propel the lid to the open position.

30 Claims, 11 Drawing Sheets

CONTAINER CAP WITH LOCKING/UNLOCKING MECHANISM THAT PROPELS LID TO OPEN POSITION

BACKGROUND OF THE INVENTION

The present invention relates to the capping of a container, particularly of the one-use or disposable type, the internal volume of which may contain contents or a filling, particularly a filling capable of flowing, for example liquid, fluid or pasty contents.

More specifically, the present invention relates to a cap intended to be mounted on a container as previously defined, particularly in a sealed manner with respect to the contents of the container.

The invention also relates to a container comprising or incorporating such a cap, empty or full, that is to say in the latter case filled with or containing contents as defined previously.

The present invention relates most specifically to caps allowing concomitantly, both the grasping of the container with which it is associated, using one hand, and the complete opening of the cap, using a digit of the same hand, for example the thumb, specifically to gain direct access for the user's mouth to the neck of the container.

DESCRIPTION OF THE PRIOR ART

Document FR-A-2 855 815 describes and proposes such a cap, comprising:

- a base comprising means for mounting on the container, particularly its neck,
- a lid comprising stoppering means, particularly ones sealed against liquids and/or gases, for stoppering either an outlet orifice that may be present on the base, or the neck of the container,
- means of articulating the lid with respect to the base having, for example, the form of a hinge, between an open position and a folded-down position, said articulation means defining an axis of rotation about which the lid can rotate, at least in the direction of opening the cap,
- locking means for locking the lid with respect to the base in its folded-down position which either adopt the form of means of clamping the stoppering means of the lid by nesting in the outlet orifice that might be present on the base, or in the neck of the container, or are clip-fastening means provided for that purpose to clip-fasten the lid or the base, or alternatively combine or associate the above two means,
- unlocking means for unlocking the lid with respect to the base, which are antagonist to the locking means defined previously, arranged to be actuated manually, in a travel toward a final position in which the aforementioned locking means are released; these unlocking means comprising for example:
  - at least one ramp belonging to the lid or to the base,
  - a flap belonging to the base or to the lid, able to move continuously against the ramp toward a final position in which the locking means are released, and comprising a free end intended to come into contact with the ramp,
  - the ramp being arranged in relation with the free end of the moving flap to determine the travel of the flap toward its final position,
- a means for the rotational elastic return of the articulation means, to the cap-open position, constrained when the latter is in the folded-down and locked position, consisting of a thin web of elastomeric plastic extending between the lid and the base.

Such a cap may be embodied in the following two ways.

In a first scenario, and as depicted in the drawings of document FR-A-2 855 815:

- the base is mounted in a sealed manner, with respect to the contents of the container, on a neck of the container and comprises a discharge duct arranged with an outlet orifice to discharge said contents,
- the lid comprises stoppering means arranged to close off the outlet orifice of the base, in a sealed manner with respect to the contents of the container,
- and when the lid is in the open position, the outlet orifice of the base is uncovered, and when said lid is in the folded-down position, the outlet orifice is closed by the stoppering means.

In a second scenario, not depicted in the drawings of FR-A-2 855 815:

- the base has an opening for the passage of a neck of the container,
- the lid comprises stoppering means arranged to close the neck of the container, in a sealed manner with respect to the contents of said container,
- when the lid is in the open position, the neck of the container is uncovered; and when said lid is in the folded-down position, the neck of the container is closed by the stoppering means.

Embodying such a cap requires the shaping, for example by injection molding, of at least two plastics, the first, thermoplastic, that makes up the structure of the cap, and the second, elastomeric plastic, that constitutes the elastic return means. For certain applications, this two-shot injection molding may constitute a disadvantage, particularly in terms of cost.

Document EP-A-0547978 describes in particular with reference to FIGS. 6 to 8, a cap comprising:

- a base comprising means of mounting on a container, comprising a discharge duct and an outlet orifice,
- a lid having the shape of a tab, comprising means for stoppering the outlet orifice on the base,
- means of articulating the lid with respect to the base, consisting of a hinge (or thin web) of plastic, between an open position and a folded-down position, defining an axis of rotation about which the lid can turn, both in the direction of opening and in the direction of closing of the cap,
- means of locking the lid with respect to the base, in its folded-down position, consisting of a clip-fastening groove provided on the discharge duct of the base, and a clip-fastening bulge provided on the outside of the stoppering means which are in the form of a tubular element,
- unlocking means, antagonist to the locking means, arranged also to actuate and move the lid toward its open position, all of this under the effect of a movement of the thumb on the hand holding the container.

These single means for unlocking and actuating comprise:

- a push-button articulated on the base comprising a pad having two branches forming a U-shaped slot between them,
- two outwardly projecting bearing surfaces on the base to collaborate in gliding contact with the respective two branches of the push-button so that pressure exerted on the latter causes the pad to pivot upward and releases the locking of the lid (cf. FIG. 7),
- two flanges projecting toward the inside of the lid, situated in the continuation of the two bearing surfaces, to collaborate in gliding contact with the two respective branches of the push-button so that continuing to exert pressure on the latter pushes the lid back in rotation toward its open position; (cf. FIG. 8).

In practice, it seems difficult, if not impossible, to close the lid again, from its open position obtained under the effect of the push-button, because the friction of the branches against the flanges, then the bearing surfaces, generates, in the direction of rotationally returning the lid to the folded-down position, jammings or even breakages definitively damaging the cap so that the latter may remain permanently open after it has first been opened.

In a similar way to document EP-A-0547978, document EP-A-1129959 proposes, as shown in particular by its FIG. 2, a cap comprising:

- a base comprising means (not depicted) of mounting on a container, comprising a discharge duct with an outlet orifice,
- a lid, comprising means of stoppering the outlet orifice on the base,
- means of articulating the lid with respect to the base, consisting of an articulated element made of plastic,
- means of locking the lid with respect to the base, in its folded-down position, consisting, on the one hand, of the clip-fastening of elastic means provided respectively for that purpose between the lid and a push-button actuating element and, on the other hand, of the wedging required for the sealing of the stoppering means in the outlet orifice of the base,
- unlocking means, antagonist to the locking means, arranged also to actuate the lid toward its open position, all this under the effect of a movement of the thumb of the hand holding the container.

With reference to FIGS. 4 to 6, these single means for unlocking and actuating comprise:

- a push-button having a partially cylindrical shape in cross section, articulated along its two edges, by virtue of a thinner part,
- an actuating element articulated to the upper part of the push-button, able to move flat on the base, comprising, on each side of an orifice allowing the passage of the stoppering means, a first ramp making it possible, in a first part of the flat movement of the actuating element, to release the locking means and a second ramp in the opposite direction to the first ramp making it possible, in a second part of the flat movement of the actuating element, to free the wedging in the outlet orifice of the base, and finally to act against bearing surfaces extending toward the inside of the lid, thus causing the latter to pivot into its open position.

This solution exhibits disadvantages of the same kind as those set out with regard to EP-A-0547978.

SUMMARY OF THE INVENTION

The subject of the present invention is a cap allowing the lid to be brought automatically into an open position by simple pressure on a push-button as soon as the locking means have been released when said lid is in the folded-down position, and for this to be done, on the one hand, entirely reversibly, that is to say with the possibility of closing and locking the lid again as many times as this lid has been opened automatically and, on the other hand, without any elastic means of rotational return to the open position, inserted or added into the cap.

According to the present invention, the overall structure or construction of the cap according to FR-A-2 855 815 is retained, and the following modifications or additions are made to it, in combination or in collaboration:

- firstly, the articulation means are arranged to, allow the lid to be propelled in rotation freely, that is to say give or take the resistance to rotation of said means, toward its open position,
- secondly, the lid and/or the base are arranged to, in their locked position, elastically resist any relative rotational movement between the lid and the base, and correspondingly store mechanical energy through elastic or plastic deformation of all or part or of the entirety of said cap, the mechanical energy thus stored, or return energy, in practice being enough to propel the lid in rotation toward its open position,
- and thirdly, the unlocking means are arranged in the form of a detent, having the function, according to the travel toward the final position of release of the locking means, of moving the lid relative to the base against the elastic resistance put up by the cap, the mechanical energy thus stored, or return energy, being released in said final position so as to propel the lid in rotation toward its open position.

The physical and/or mechanical principles supporting the technical features listed hereinabove will be illustrated hereinafter with reference to the diagram according to FIG. 19, once an exemplary embodiment according to FIGS. 1 to 9 has been fully described.

According to the present invention it must be understood that:

- the articulation means according to the invention therefore comprise no means of elastically returning the lid in rotation toward the open position, for example no element made of viscoelastic material which is stressed in rotation when the lid is in the folded-down position,
- and/or the articulation means are not arranged, for example in terms of the material of which they are made and/or in terms of their shape, to generate a substantial elastic return torque rotating the lid toward the open position, for example by being stressed in terms of rotation when the lid is in the folded-down position.

The present invention also comprises the following variants:

- the cap is arranged to localize the elastic deformation to at least one of the following elements, namely the base, the lid, the locking means and the articulation means,
- the stored mechanical energy, or return energy, is greater, through the construction, than the energy required to release the locking of the lid with respect to the base plus the energy required to overcome or exceed the intrinsic resistance to rotation of the articulation means,
- still through the construction of the cap, the stored mechanical energy is sufficient to propel the lid in rotation into an open position, at least at 100° with respect to the folded-down position, with respect to the axis of rotation of the articulation means,
- as a preference, the cap is arranged or constructed to specifically localize the elastic deformation into all or part of the locking means,
- alternatively, the stoppering means are arranged for sealed closure of the opening made in the base or in the neck of the container, requiring antagonist energy in order to release them and break the seal; in such a case, these sealed stoppering means may serve as means for locking the lid with respect to the base in its folded-down position; in such a case, in any event, the stored mechanical energy is greater, through the construction of the cap, than the energy required to release the stoppering means and/or the locking of the lid with respect to the base, plus the energy required to overcome the intrinsic resistance to rotation of the articulation means.

In total, the present invention culminates in a cap which is particularly simple to produce or obtain industrially, for example by injection molding a single plastic, and this can be done as appropriate in a one-piece style, the opening of this cap in particular not being dependent on the phenomena of creep of the plastic employed, for example at the articulation means or the hinge between the base and the lid.

DESCRIPTION OF THE PREFERRED EMBODIMENTS AND OF THE DRAWINGS

Two preferred embodiments of the invention are considered, the first depicted and described with reference to the attached drawing, and the second not depicted.

According to the first embodiment:

- the base is mounted in a sealed manner, with respect to the contents of the container, on the neck of the latter and comprises a discharge duct arranged to discharge the contents of the container, comprising an outlet orifice;
- the stoppering means of the lid are arranged to close off the outlet orifice of the base, in a sealed manner with respect to the contents of the container,
- when the lid is in the open position, the outlet orifice of the base is uncovered, and when the lid is in the folded-down position, the outlet orifice is closed.

According to the second embodiment, not depicted:

- the base comprises an opening for the passage of the neck of the container;
- the stoppering means of the lid are arranged to close off the neck of the container, in a sealed manner with respect to the contents of said container;
- when the lid is in the open position, the neck of the container is uncovered, and when said lid is in the folded-down position, the neck of the container is closed.

By way of example, not depicted, the hinge comprises at least one element connecting the base and the lid, for example a thin web, formed integrally with the lid and the base, arranged, for example sufficiently thin, to allow the rotational movement of the lid from its folded-down position to its open position, with a limited intrinsic resistance to rotation.

The present invention is now described with reference to the attached drawing, in which.

Figure 1:
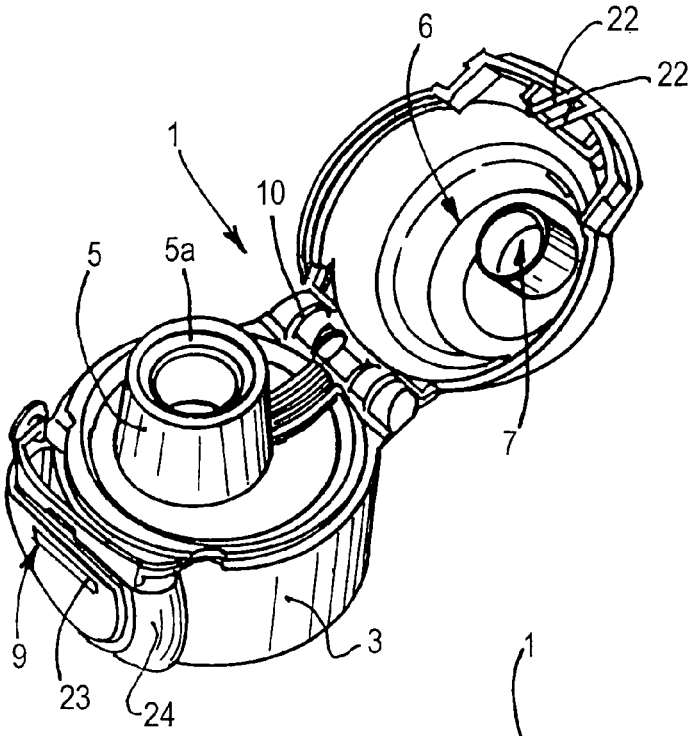
FIGS. 1 and 2 depict, in perspective, a first embodiment of a cap according to the invention, in the open position and in the folded-down or closed position, respectively.
Figure 2:
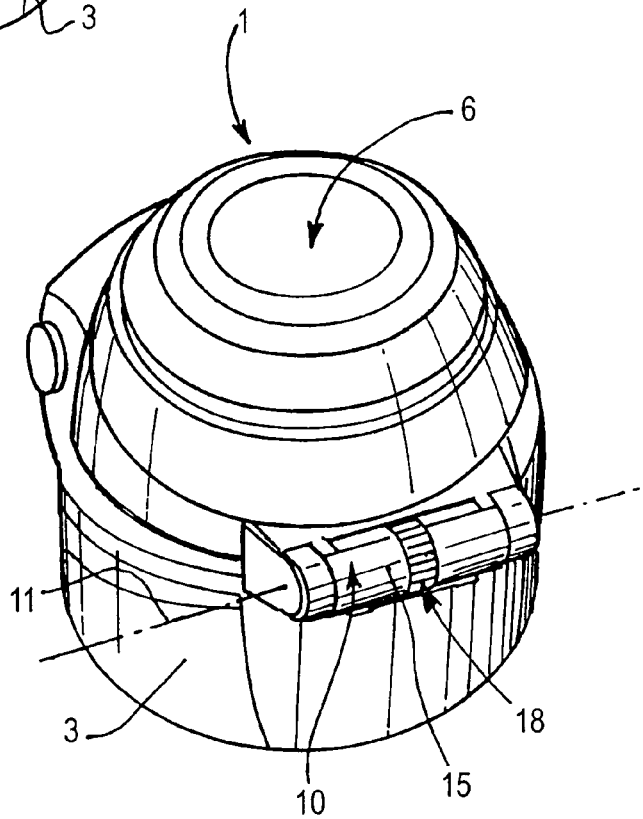
Figure 10:
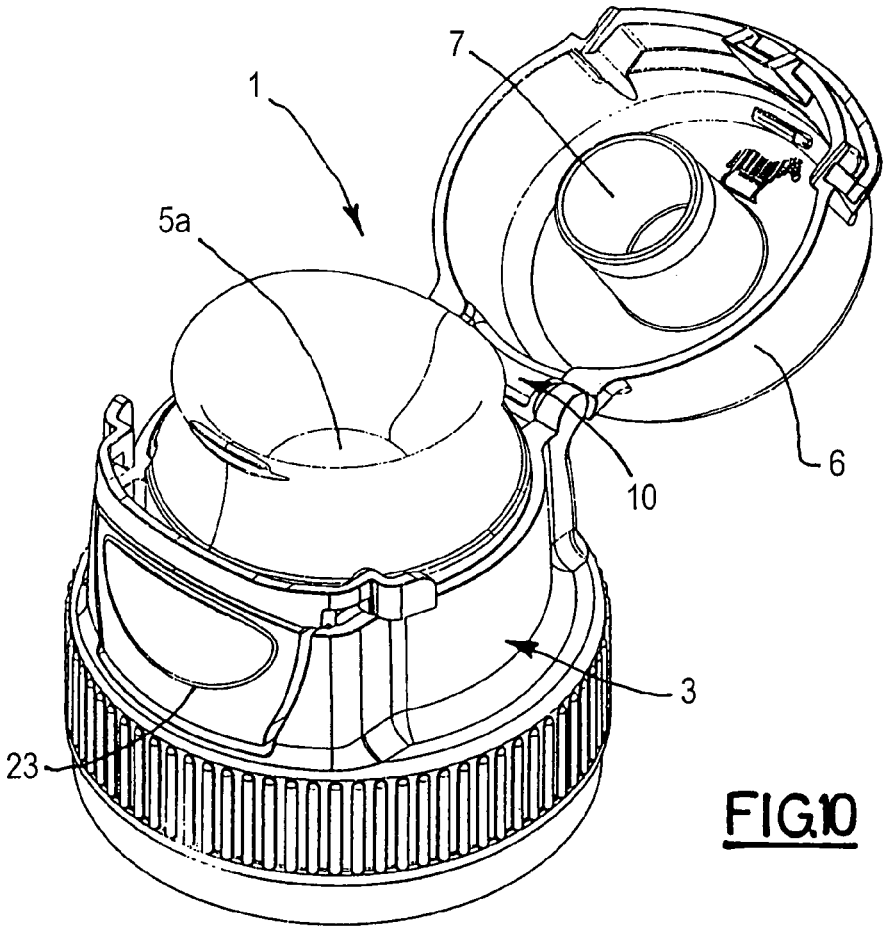
Figure 11:
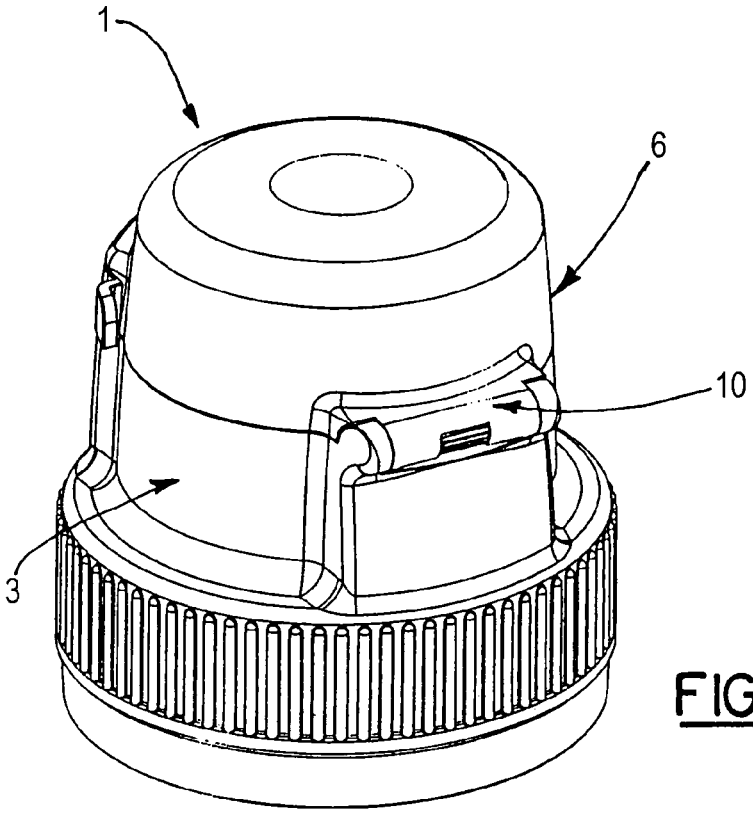
Figure 12:
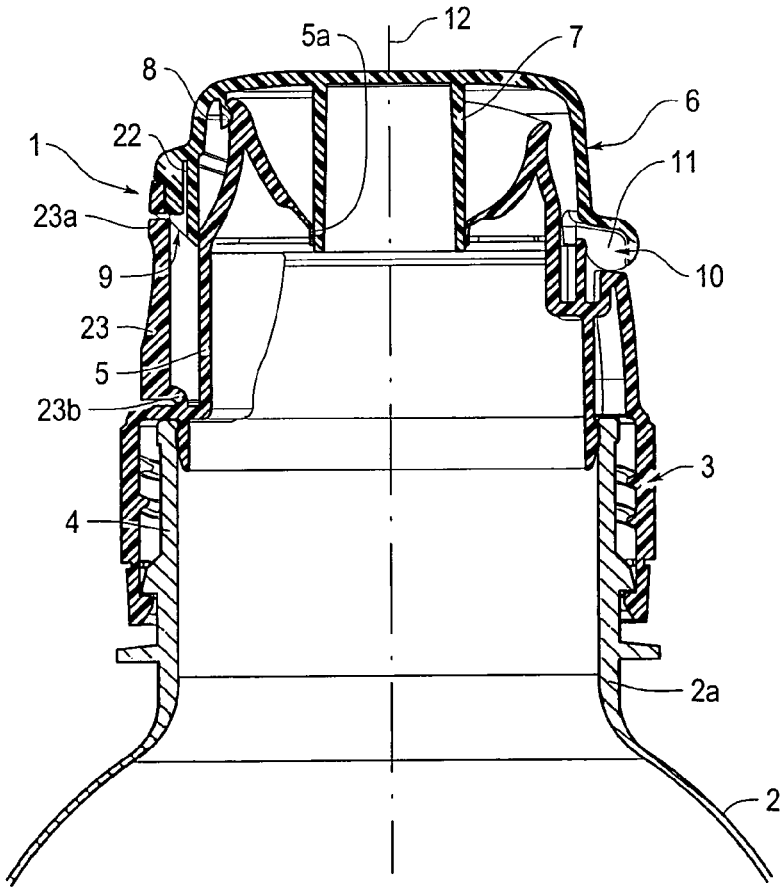
Figure 13:
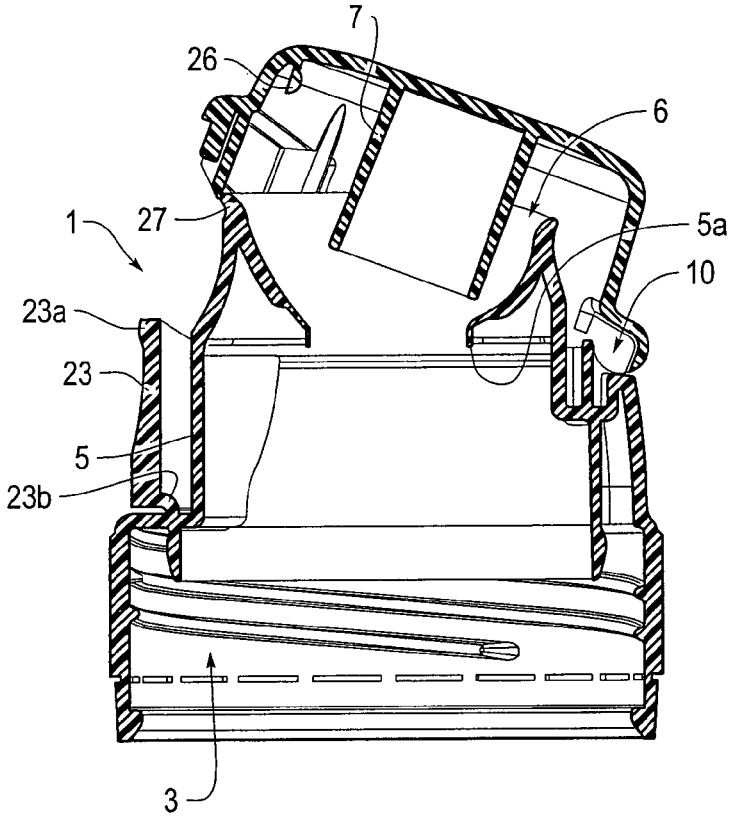
Figure 14:
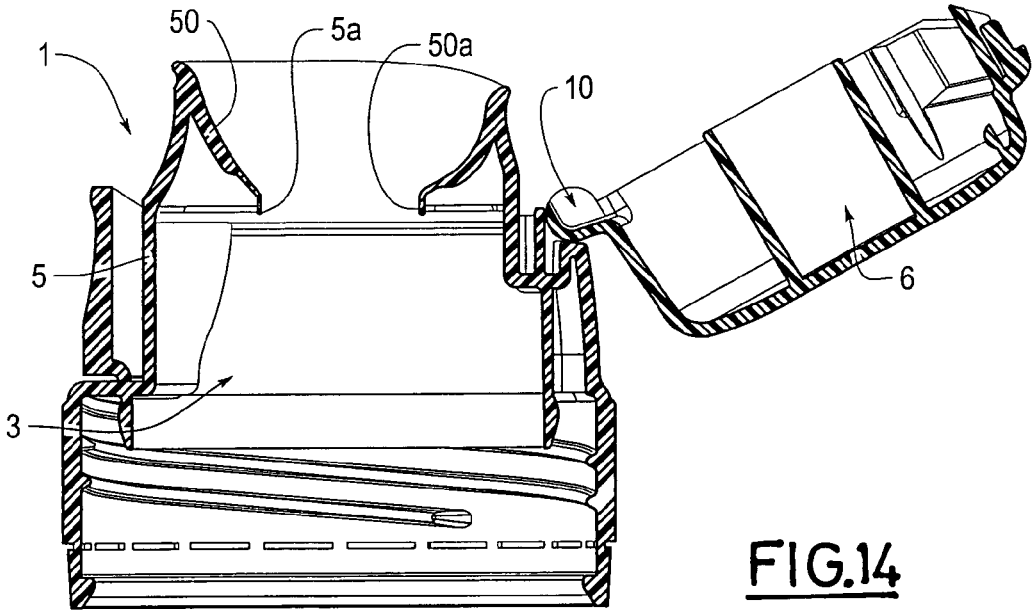
Figure 15:
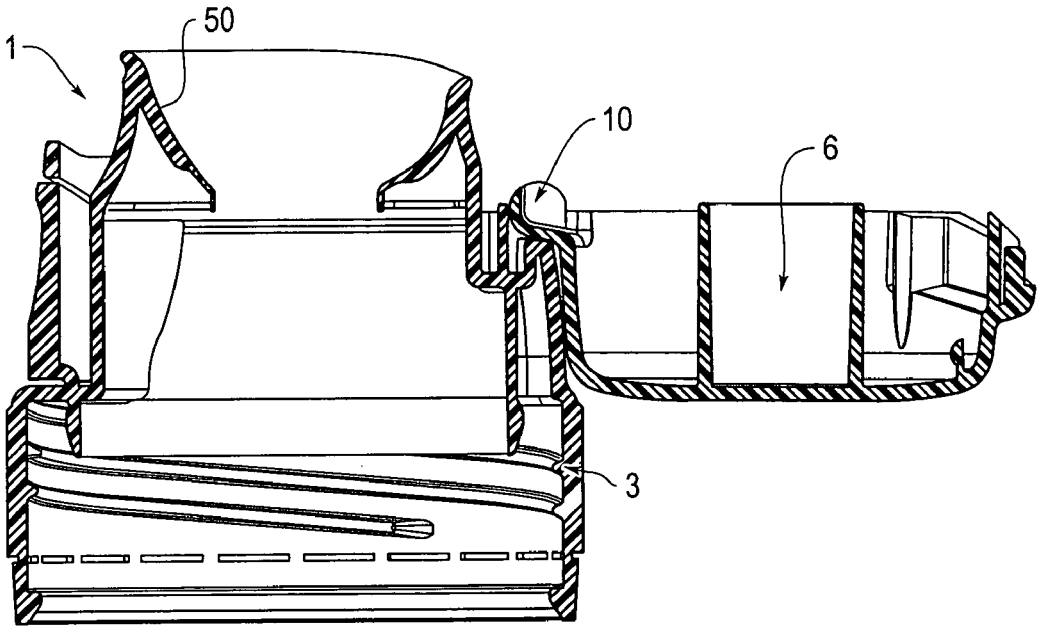
Figure 16:
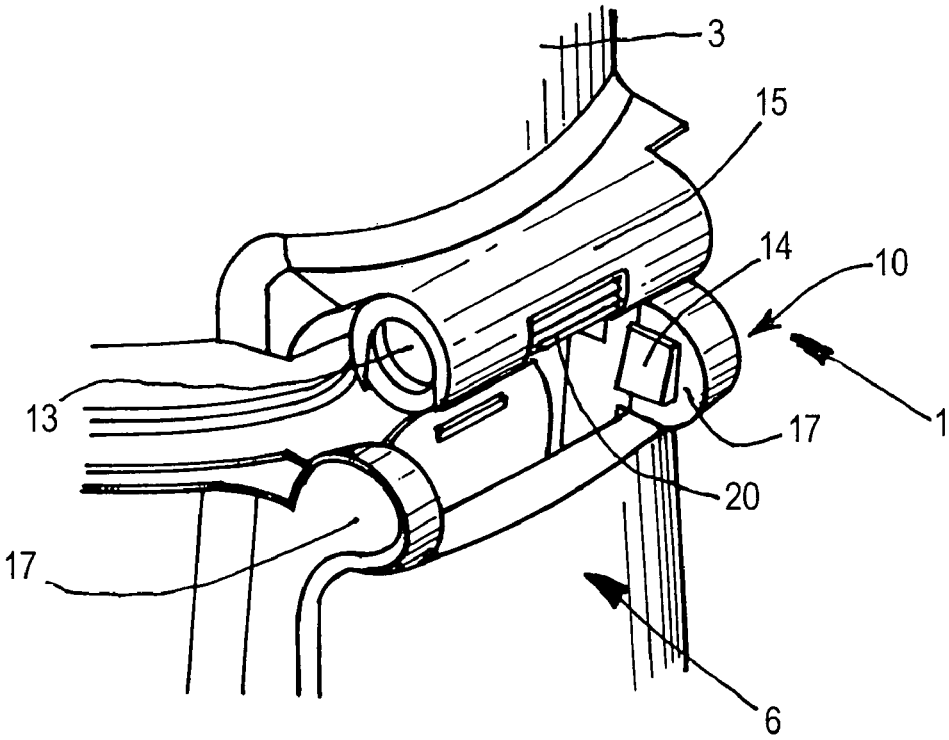
Figure 17:
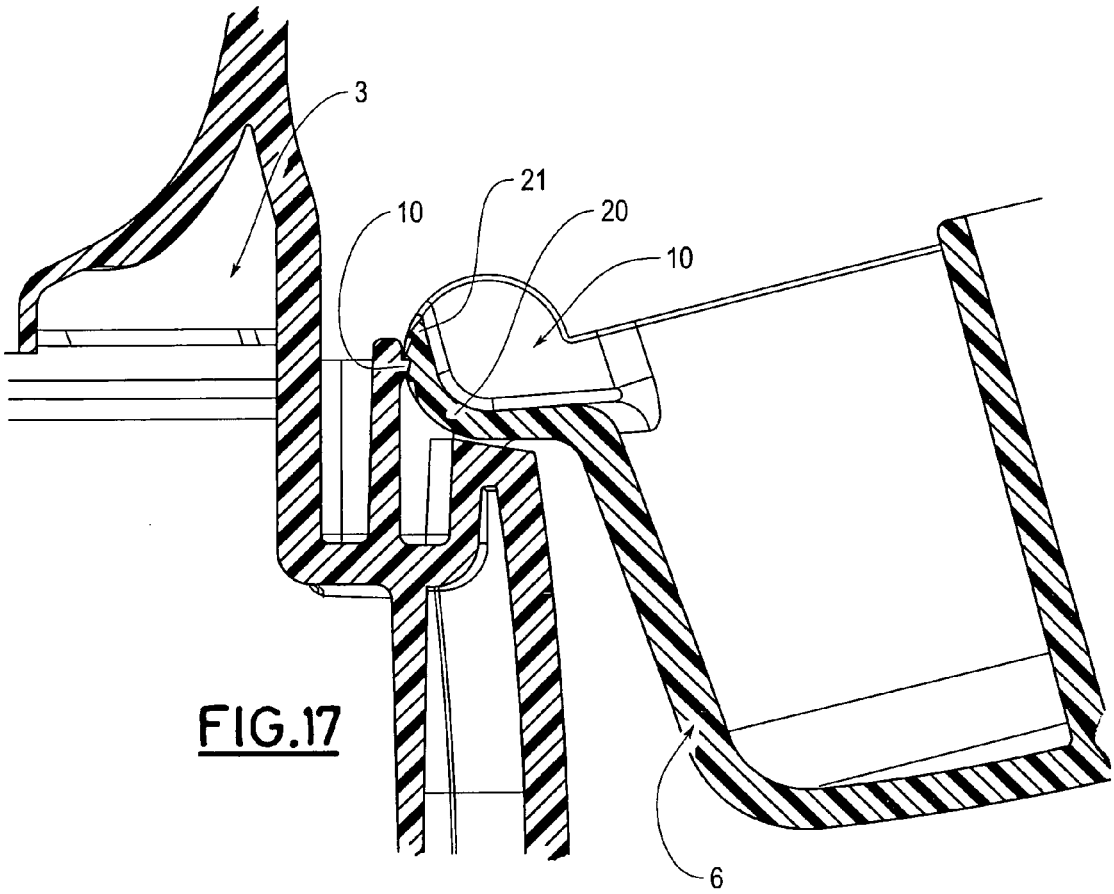
Figure 18:
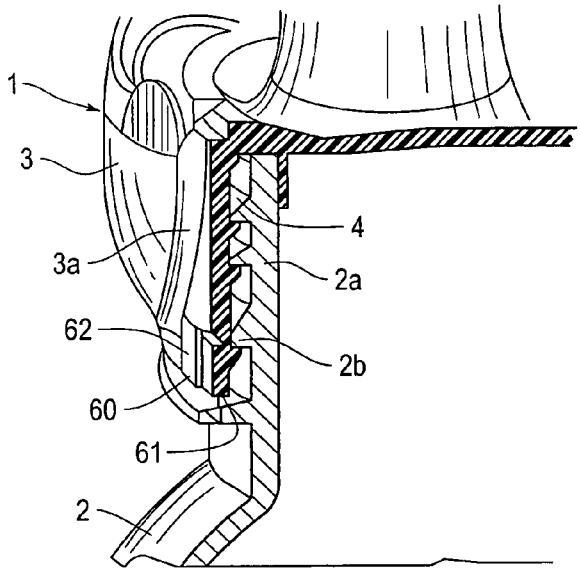
Figure 19:
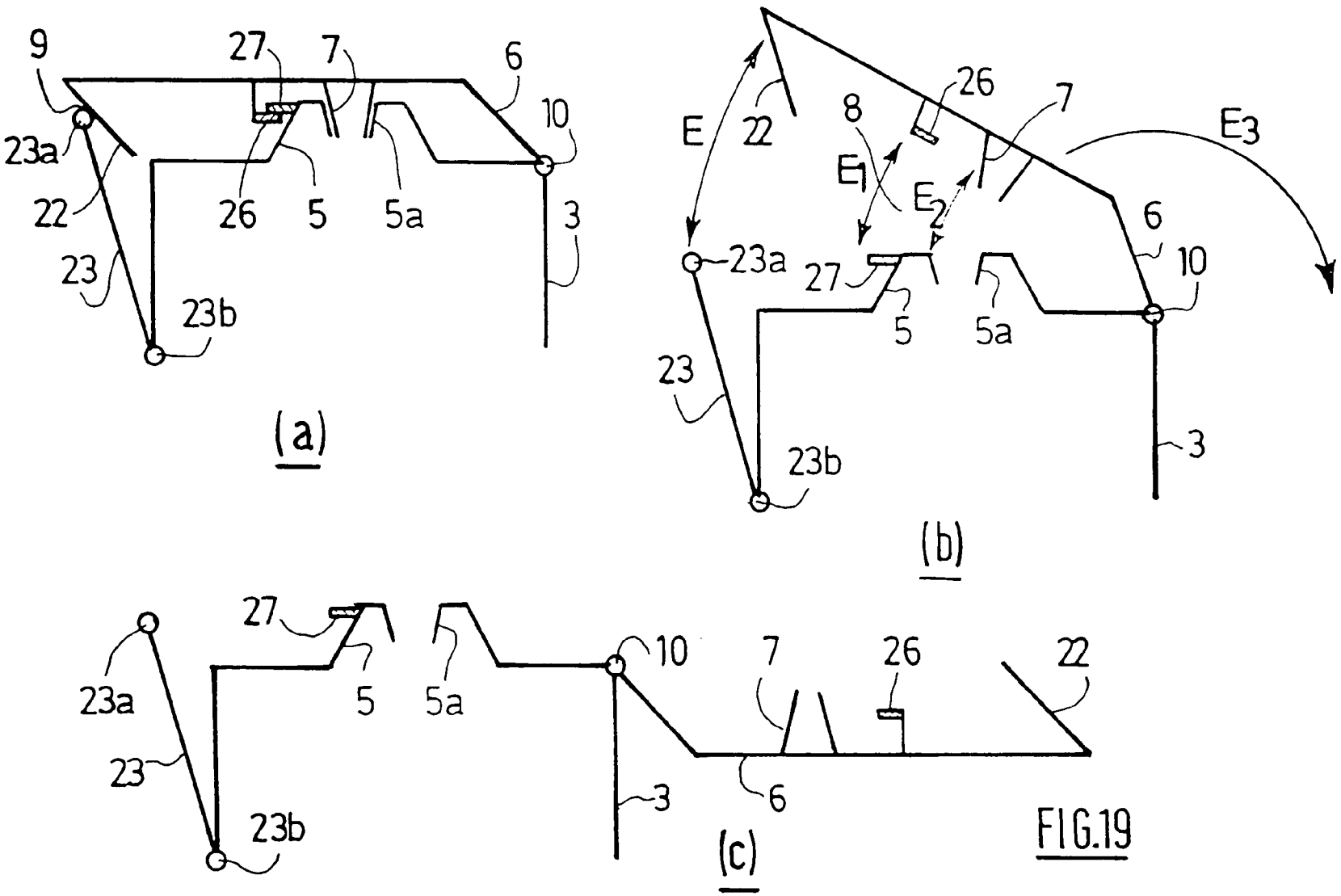

just like FIGS. 1 and 2,

FIGS. 10 and 11 depict a second embodiment of a cap according to the invention, in the open position and in the folded-down or closed position, respectively;

FIG. 12 depicts a view in axial section of the cap depicted in FIGS. 10 and 11;

FIGS. 13 to 15 depict, starting from the folded-down or closed position of FIG. 12, three phases respectively leading to the complete opening of the cap according to FIGS. 10 to 12;

FIGS. 16 and 17 depict, respectively in perspective and in an exploded view, and in axial section, the articulation means belonging to the cap depicted according to FIGS. 10 to 12, FIG. 18 depicts, in perspective and with partial cutaway, a cap according to a third embodiment of the invention, shown in a position mounted on the neck of a container, FIG. 19 depicts a conceptional and/or explanatory diagram of a cap according to the present invention, respectively in three relative configurations, the first in the folded-down and locked position, the second in the process of being opened, and the third in the completely open position.

Figure 3:
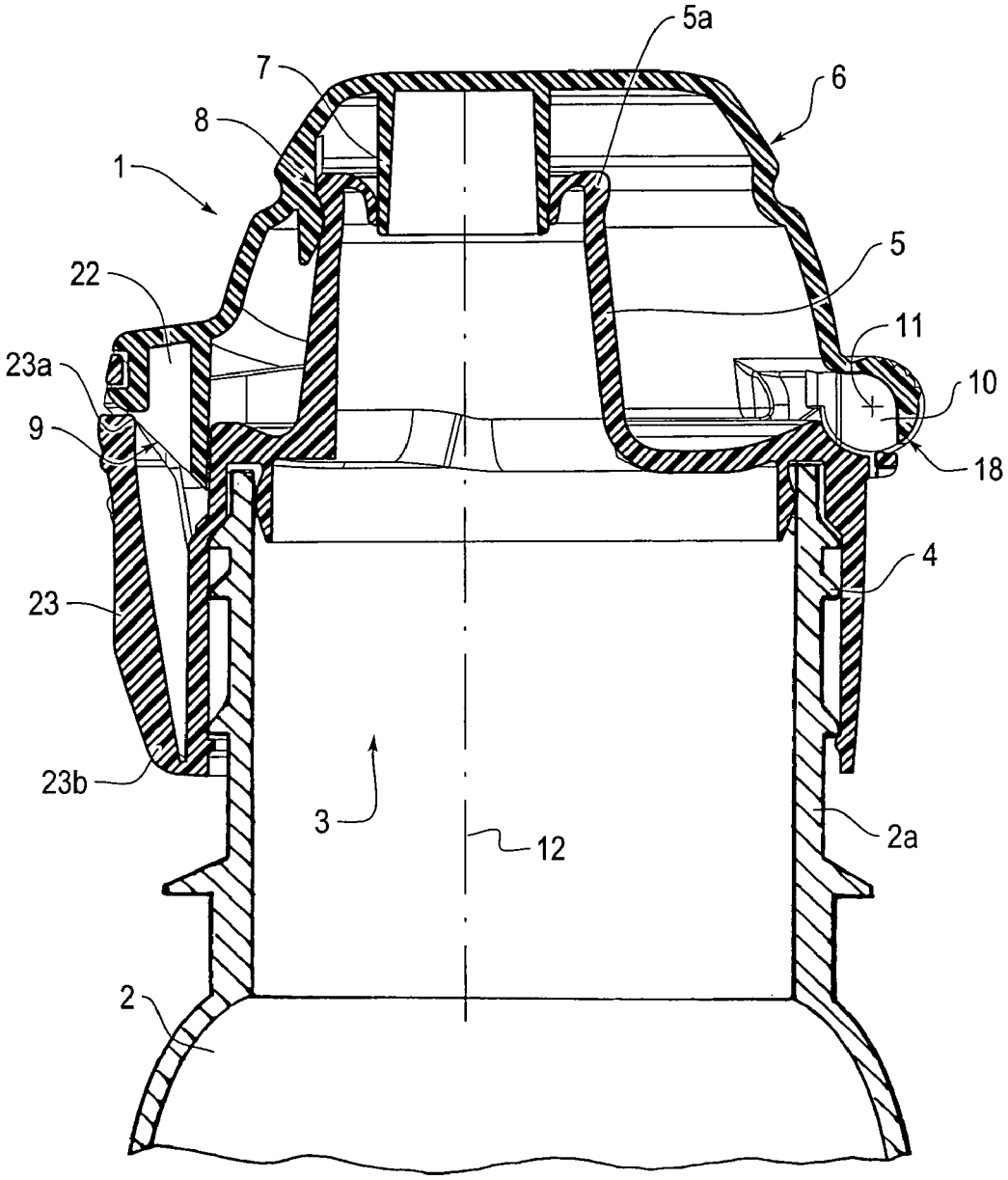
FIG. 3 depicts a view in axial section of the cap according to FIGS. 1 and 2.

According to FIGS. 1 to 3, a cap according to the invention is intended to be mounted (cf. FIG. 3) on a container 2, the internal volume of which may contain contents able to flow, for example liquid.

Basically, such a cap comprises:

- a base 3 comprising means 4 for mounting on the container 2, particularly its neck 2*a*,
- a lid 6 comprising stoppering means 7,
- means of articulating the lid 6 with respect to the base 3, between an open position (cf. FIG. 7) and a folded-down position (cf. FIGS. 2 and 3); these articulation means comprise a hinge 10 defining an actual or imaginary axis 11, about which the lid 6 can rotate or pivot freely, subject to friction or other intrinsic resistance, in particular resistance to rotation, at least in the direction for opening the cap.

The base 3 is mounted in a sealed manner with respect to the liquids and/or gases with respect to the contents of the container 2, on the neck 2*a* of the latter, and comprises a discharge duct 5 arranged to discharge the aforementioned contents, and comprising an outlet orifice 5*a*. The stoppering means 7 of the lid 6 are arranged to close the outlet orifice 5*a* of the base 3, in a sealed manner with respect to the contents of the container 2. When the lid 6 is in the open position (cf. FIG. 7), the outlet orifice 5*a* of the base 3 is completely uncovered, for example to allow it to access the mouth, and when the lid 6 is in the folded-down or closed position (cf. FIG. 3), the outlet orifice 5*a* is closed.

The lid 6 and the base 3 are two separate parts connected to one another, freely in rotation, by the articulation means with hinge 10.

Figure 8:
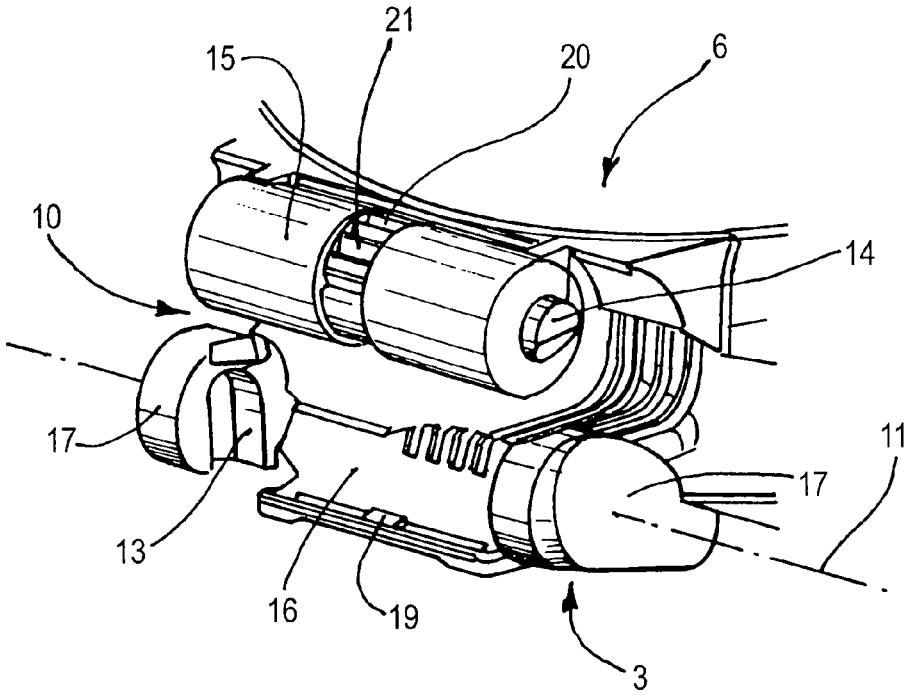
FIGS. 8 and 9 depict, respectively in perspective and in an exploded view and in axial section, the means of articulation between the base and the lid.
Figure 9:
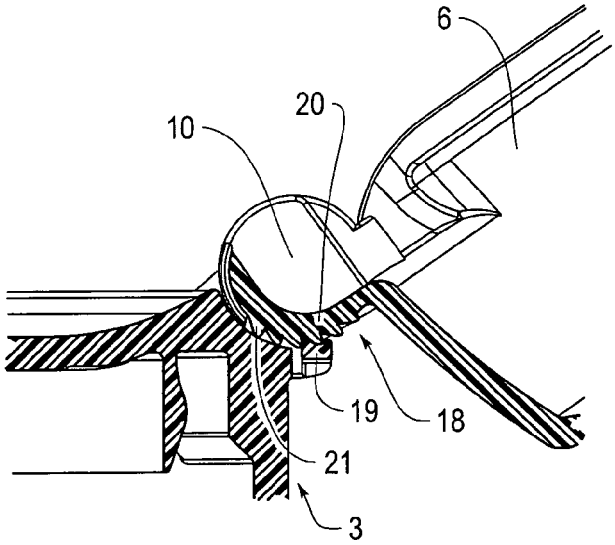

As shown more particularly by FIGS. 8 and 9, the hinge 10 is composed, on the one hand, of at least two female elements 13, arranged along the axis of rotation 11 of the hinge 10, belonging respectively to the lid 6 or to the base 3 and, on the other hand, of at least two complementary male elements 14, mounted to rotate freely in the two aforementioned female elements respectively, for their part arranged along the axis of rotation 11, belonging respectively to the base 3 or to the lid 6.

The two male elements 14 and/or the two female elements 13 of the hinge 10 comprise or are associated with means allowing them to be wedged in (cf. FIG. 8) by simple pressure or translational movement of the lid 6 with respect to the base 3, the lid 6 and the base 3 being arranged parallel one above the other.

More specifically, as shown by FIG. 8, on one side, the lid 6 comprises a barrel 15 provided with two pegs 14 opposed along its axis, corresponding to the axis of rotation 11 of the hinge 10, forming the two male elements thereof; and, on the other side, the base 3 comprises, on the one hand, a cradle 16 for accepting the barrel 15 such that it can rotate freely and, on the other hand, on each side of said cradle, two lugs 17 comprising two housings 13 for accepting the two pegs 14 respectively such that they can rotate freely, these housings 13 forming the two female elements of the hinge 10. The two pegs 14 and/or the two lugs 17 comprise means, for example cut facets or flats, allowing their respective clip-fastening, for example by simple pressure of the lid 6 on the base 3 (cf. FIG. 8).

As a consequence of the articulation means 10 described hereinabove, there is admittedly some intrinsic resistance to rotation of the lid 6, both toward the open position and toward the folded-down position, as a result in particular of friction of the hinge; however, the energy required to pivot the lid 6 from its folded-down position into its open position remains reasonable, and can easily be determined.

Figure 4:
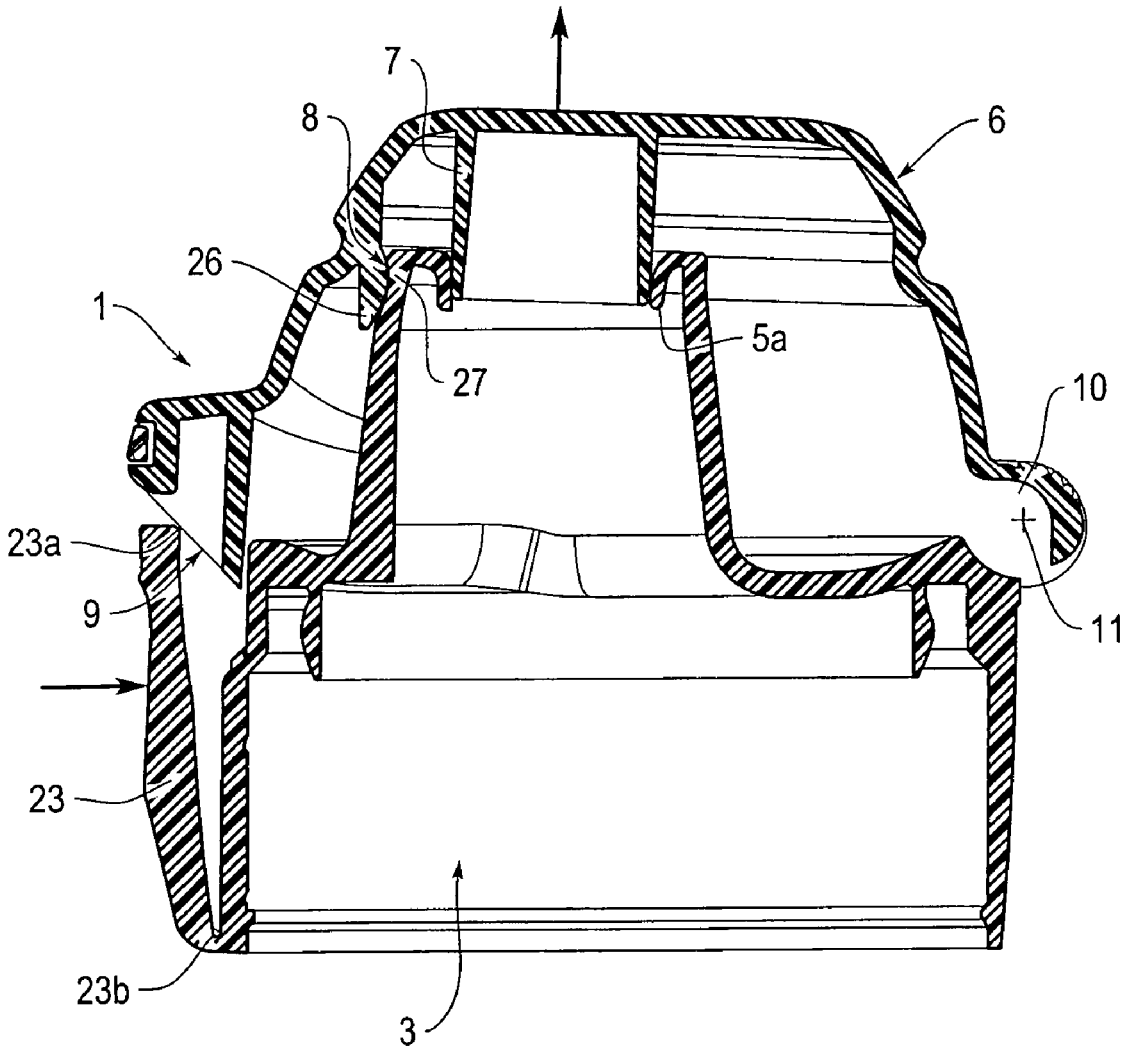
FIG. 4 depicts, on a larger scale and in section, two details of the cap according to FIGS. 1 to 3, relating to the locking and unlocking means, the latter being in an intermediate position between their original position depicted in FIG. 3 and their final position in which the locking means of the cap are released.

As shown more particularly in FIG. 4, the locking means 8 between the base 3 and the lid 6 comprise two bearing surfaces 26 and 27 in gliding contact with one another, these belonging respectively to the base 3 and to the lid 6. The curved profile of these two bearing surfaces respectively is determined to allow, during the relative movement of one over the other toward a final position, firstly, as appropriate, a relative and limited movement of the lid 6 with respect to the base 3, but without releasing the locking means 8, with, correspondingly, resistance offered by elastic deformation of the cap 1 and, in particular, of the base 3 and/or of the lid 6 and more specifically in this case plastic deformation of the discharge duct 5 at its outlet orifice 5*a* and/or of a pip constituting the bearing surface 26 belonging to the lid 6 and finally, in the final relative position of the bearing surfaces 26 and 27, complete and abrupt release of the lid 6 with respect to the base 3, the base and/or the lid, in this instance the discharge duct 5 at its outlet orifice 5*a*, and the pip constituting the bearing surface 26, then resuming their initial respective shapes.

The means 8 of locking the lid 6 on the base 3 are therefore of the clip-fastening type, when the lid 6 is in the folded-down position, and are arranged between the lid and the base at the opposite side to the hinge 10 with respect to the axis of rotation 11 thereof.

Because of the locking means 8 described hereinabove and the choices made by construction to localize the elastic deformation of the cap 1 to certain parts thereof, on the one hand, the energy or force imparted hereinafter to the unlocking means 9 described hereinafter will need to overcome the resistance offered by the locking means 8 and the discharge duct 5 and, on the other hand, this force, greater than this resistance, will lead to the storage of the mechanical energy in these parts (pip 26 and duct 5) because of their deformation.

The unlocking means 9, antagonist to the locking means 8, are also arranged between the lid 6 and the base 3 and comprise:

- at least one ramp 22 belonging respectively to the lid 6 or to the base 3,
- a flap 23, belonging respectively to the base 3 or to the lid 6, able to move continuously, for example in a rotational or articulated travel, toward a final position in which the locking means 8 are themselves in their final position and released; for this purpose, the flap 23 comprises a free end 23*a* intended to come into contact with the ramp 22,
- the ramp 22 being arranged in relation with the free end 23*a* of the moving flap 23 in such a way as to determine the travel of said flap 23 toward the aforementioned final position.

As depicted in FIG. 3, the ramp 22 belongs to the lid 6 and the flap 23 to the base 3.

By molding or injection molding a single same plastic, the flap 23 is formed integrally with the base 3, and the ramp 22 is formed integrally with the lid 6 and is directed, when the lid 6 is in the folded-down position, toward the outside and away from the base 3 (cf. FIG. 3).

As best depicted in FIG. 1, the base 3 comprises two more or less parallel external wings 24 extending obliquely, forming between them a protected volume within which the flap 23 is able to pivot about its end 23*b* secured to the base 3, the opposite end to the free end 23*a*.

Because of the unlocking means 9 described hereinabove, it is the latter which are driving and, by applying the force developed by the user's thumb over the entire length of the travel of the flap 23 along the ramp 22 impart the energy or force required firstly to overcome the resistance of the cap 1 to opening, because of the resistance put up by the locking means 8 and, as appropriate, other parts of the cap such as the discharge duct 5 in relation to the stoppering means 7, then to store the mechanical or return energy required for, when the time comes, propelling the lid 6 in rotation toward its open position through elastic deformation of all or part of said cap.

Figure 5:
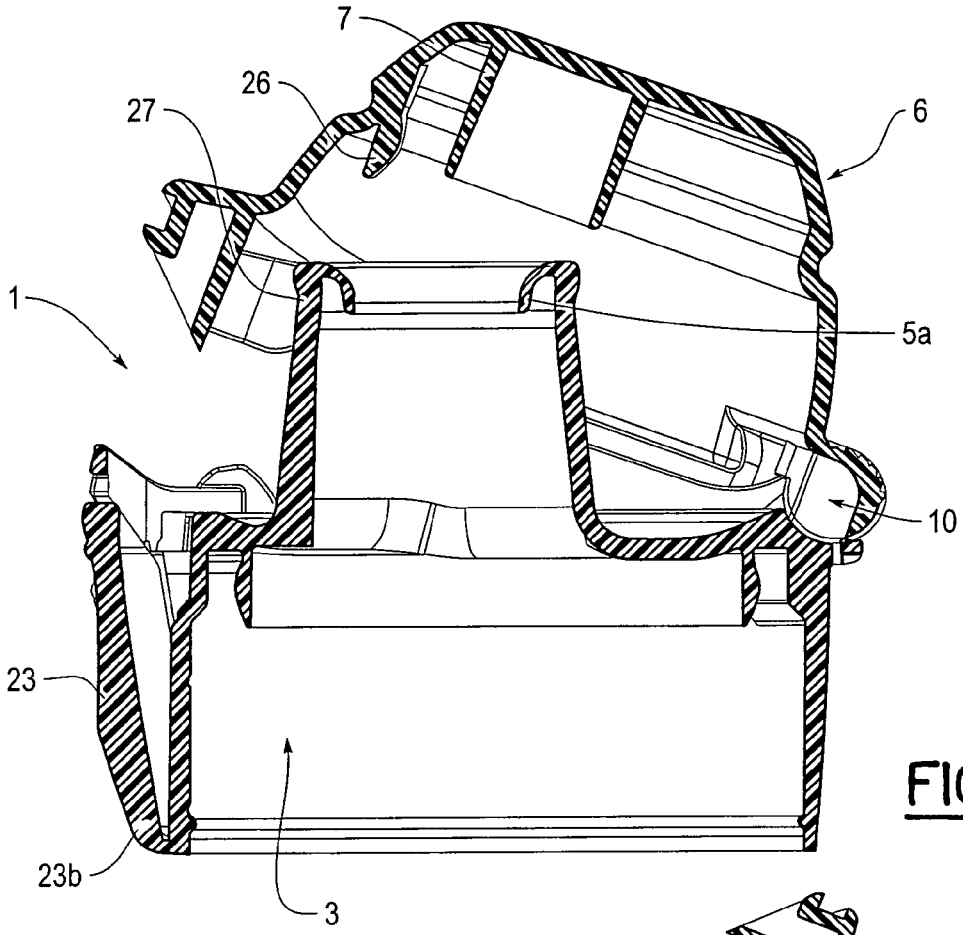
FIGS. 5 to 7 depict three phases respectively leading to the complete opening of the cap, from its folded-down or closed position shown in FIG. 3.
Figure 6:
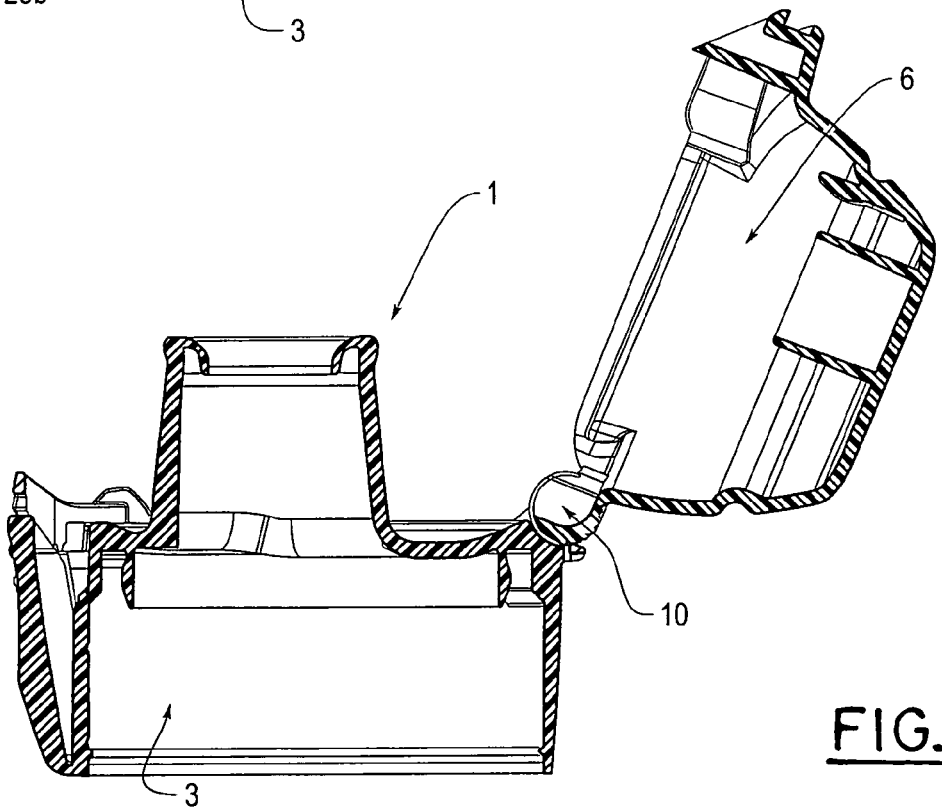
Figure 7:
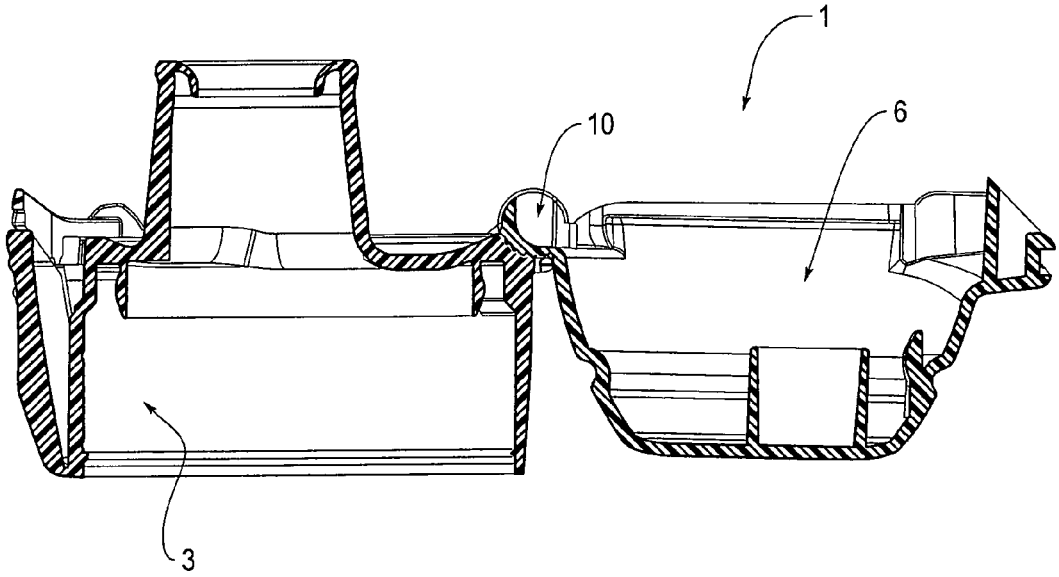

According to the first embodiment of the present invention:

- on the one hand, the lid 6 is arranged, for example at the locking means 8, that is to say in a region of said lid 6 in contact with the base 3, to elastically resist any relative movement between the lid and the base, and in return store mechanical energy through deformation of the lid and/or of the base; cf. preceding description of the locking means 8, with reference to FIG. 4; in practice, the mechanical energy thus stored is enough to propel the lid 6 in rotation toward its open position (cf. FIG. 7), by exceeding the resistance to rotation of the articulation means with hinge 10, for example by friction or because of their intrinsic stiffness,
- and, on the other hand, the unlocking means 9 previously described (for example, cf. FIG. 3), are arranged in the form of a detent having the function under the manual action of a digit of the user, and according to a travel (cf. FIG. 4) toward the final position in which the locking means 8 are released:
  - first of all, as appropriate, of moving the lid 6 relative to the base 3, storing up mechanical energy because of the elastic or plastic deformation, for example, of the locking means 8,
  - and then, when the unlocking means 9 are in the final position, of releasing the lid 6 relative to the base 3, the mechanical energy released at the locking means 8 allowing the lid 6 to be propelled and, in practice propelling it, in rotation toward its open position (cf. FIGS. 5 to 7).

As a preference, the open position of the lid 6 with respect to the base 3 is at least at 100°, for example at 180° or a 190°, from the folded-down or closed position (cf. FIG. 2) with respect to the axis of rotation 11 of the hinge 10.

According to the present invention, it must be understood that the spring or return effect allowing the mechanical energy to be formed and stored for propelling the lid 6 in rotation with respect to the base 3 may be obtained in any region whatsoever or in several regions of the cap 1, particularly of said lid in contact with the base 3, provided that the elastic deformation of said regions, in practice of the lid and/or of the base, under the effect of the actuation of the unlocking means 9, is able to store mechanical energy that is instantly releasable when said unlocking means are in the final position to propel the lid 6 in rotation toward its open position, and to do so without any other mechanical or manual influence on this lid.

In certain cases, for example when the cap allows the container 2 to be drunk from directly, means 18 of halting or slowing the rotational return of the lid 6 from its open position to its folded-down or closed position are formed between the base 3 and the lid 6. As best shown by FIGS. 8 and 9, these halting or slowing means 18 comprise:

on the side of the base 3 or of the lid 6, a stop tooth 19 and, in register with it, on the side of the lid 6 or of the base 3, a serrated annulus 20 about the axis 11 of rotation of the hinge 10, the serrations 21 of which escape from the stop tooth 19 in the direction of opening of the lid 6 from its folded-down position, and the serrations 21 of which mesh flexibly with the stop tooth 19 in the direction of the return of the lid from its open position to its folded-down position.

The flexible meshing in any event makes it possible, via an additional force, to disengage the serrations 21 from the tooth 19 and fold the lid 6 down.

Definitely speaking, the design and operation of a cap according to the present invention can be modeled as described hereinafter with reference to FIG. 19.

In general, according to the invention, on one side, the "drive" means that the unlocking means 9 constitute generate energy (E) more or less equal to the force applied to the flap 23 multiplied by the length of the travel of the flap against the ramp 22, as far as the final position in which the locking means 8 are released.

On the other side, with respect to the axis of the articulation means 10, there is resistance, and therefore energy required to release this resistance, namely (E1) to release the locking means 8 or 26/27 and/or (E2) to release the stoppering means 7 with respect to the outlet orifice 5*a*.

As mentioned, through design and/or construction, the cap 1, that is to say all or part thereof, for example the lid 6 and/or the base 3, are arranged to be able to deform elastically, when the lid 6 is in the folded-down and locked position and the cap 1 is therefore closed, and correspondingly by deformation absorb at least the energy (E) developed at the push-button.

Bearing in mind the freedom of the lid 6 to rotate with respect to the base 3 about the articulation means 10, give or take the rotational friction, kinetic energy (E3) needs to be applied in order to propel the lid 6 in rotation toward its open position.

According to the present invention, the energy (E) is at least equal to (E1)+(E2)+(E3). This energy is stored, when the lid is in the same locked position, in all or part of the elastically deformed cap 1 and released as soon as the locking means 8 and/or the stoppering means 7 is/are released. The energy thus released then allows the lid 6 to be propelled into the open position, automatically rearward.

The second embodiment of the invention, depicted with reference to FIGS. 10 to 18, unlike the first embodiment, also has the following characteristics:

in terms of the means of articulation with hinge 10, as shown by FIGS. 16 and 17, on one side, the lid 6 comprises a barrel 15 provided with at least two housings 13, arranged along its axis, forming the two female elements of the hinge and, on the other side, the base 3 comprises at least two lugs 17 comprising two pegs 14 fitting with freedom to rotate into the two housings 13 respectively, forming the two male elements of the hinge 10. As shown more particularly in FIG. 16, the two pegs 14 and/or the two ends of the barrel 15 comprise means, for example cut facets or flats, allowing the two pegs to be clip-fastened into the two housings respectively, by simple pressure of the lid 6 on the base 3.

Furthermore, the discharge duct 5 is closed by a cup 50 forming, at its center, along the axis of the discharge duct 5, a straight-edged opening 50*a* (see FIGS. 13, 14, 15) collaborating in a sealed manner, when the lid 6 is in the folded-down position, with the stoppering means 7 which consist of a cylindrical finger 7. This arrangement has the advantage of combining, on the one side, the bearing of the lips against the base of the cap in the cup 50, to encourage air to return into the container 2 and, on the other side, good sealing, notwithstanding the internal pressure exerted on the base 3 from the container 2.

According to FIG. 18, the third embodiment of the invention differs from the first embodiment or from the second embodiment in that:

the base 3 comprises, on the side of its edging 3*a*, a tamperproofing ring 60 comprising hooks 61 engaging with the neck 2*a* of the container, in the direction of the unscrewing of the cap with respect to the container 2, and escaping from said neck in the direction of fitting, for example by pushing, of the cap on said neck, said ring being connected to the remainder of the base by frangible bridges 62 which rupture in the direction of the unscrewing of the cap.

the tamperproofing ring 60 extends circumferentially over half the circumference of the base, the hooks 62, of which there are two, are arranged respectively at the two respective ends of the ring 60 so as to fit under a collar 2*b* formed on the neck 2*a* of the container 2.

The invention claimed is:

1. A cap configured to be mounted on a container having an internal volume, the cap comprising:

a base comprising means for mounting the cap on the container;

a lid;

means for articulating the lid with respect to the base, between an open position and a folded-down position, defining an axis of rotation about which the lid can rotate;

locking means for locking the lid with respect to the base in the folded-down position;

unlocking means for unlocking the lid with respect to the base, which is antagonist to the locking means, arranged to be actuated manually, and movable to a final position at which the unlocking means triggers the lid to move toward the open position;

wherein the articulation means is arranged to allow the lid to be propelled in rotation by a mechanical energy stored in at least one of the base and the lid due to deformation of at least one of the base and the lid toward the open position;

the lid and the base are arranged to, in locked position elastically resist relative rotational movement between the lid and the base, and correspondingly store the mechanical energy through deformation of at least one of the base and the lid, the mechanical energy stored during deformation being enough to propel the lid in rotation toward the open position; and the unlocking means is arranged in the form of a detent, which when moved to the final position unlocks the locking means, causing movement of the lid relative to the base, the stored mechanical energy caused by the deformation being released propelling the lid in rotation toward the open position.

2. The cap as in claim 1, wherein the articulation means consists of means for rotation of the lid between the open position and the folded-down position.

3. The cap as in claim 1, wherein the articulation means contribution of torque to rotating the lid toward the open position consists of friction from within the articulation means.

4. The cap as in claim 1 and which is arranged to localize the elastic deformation to at least one of the base, the lid, and the locking means.

5. The cap as in claim 1, wherein the mechanical energy stored is greater than the energy required to release the locking means of the lid with respect to the base plus the energy required to overcome the resistance to rotation of the articulation means.

6. The cap as in claim 1, wherein the mechanical energy stored is sufficient, to propel the lid in rotation into the open position with respect to the axis of rotation of the articulation means.

7. The cap as in claim 1, wherein the unlocking means further comprises:

at least one ramp incorporated into one of the lid and the base;

a flap incorporated into one of the base and the lid that does not incorporate the at least one ramp, configured to move continuously against the ramp toward the final position in which the locking means is released, and comprising a free end configured to come into contact with the ramp; and the ramp arranged in relation with the free end of the moving flap such that the ramp determines the travel of the flap toward the final position.

8. The cap as in claim 7, wherein the ramp is incorporated into the lid and the flap is incorporated into the base.

9. The cap as in claim 8, wherein the flap is formed integrally with the base, and the ramp is formed integrally with the lid and is directed, when the lid is in the folded-down position, toward the outside and away from the base.

10. The cap as in claim 8, wherein the base comprises two substantially parallel external wings extending obliquely, forming between the substantially parallel external wings a protected volume within which the flap is able to pivot about an end secured to the base, the opposite end to the free end.

11. The cap as in claim 1, the locking means further comprises:

a clip-fastening type locking means arranged between the lid and the base.

12. The cap as in claim 11 and which is configured to localize the elastic deformation to the locking means.

13. The cap as in claim 12, wherein the locking means comprises two bearing surfaces in gliding contact with each other, one bearing surface belonging to the base and one bearing surface belonging to the lid, the respective profiles of the bearing surfaces are configured to allow, during their relative movement toward the final position, a non-free elastically constrained movement of the lid with respect to the base and finally, in the final position, release of the lid with respect to the base, the base and the lid then resuming their initial respective shapes.

14. The cap as in claim 1, wherein:

the base is mounted in a sealed manner, with respect to contents of the container, on a neck of the container and comprises a discharge duct arranged with an outlet orifice for discharging the contents, the lid comprises stoppering means arranged to close off the outlet orifice of the base, in a sealed manner with respect to the contents of the container, when the lid is in the open position, the outlet orifice of the base is uncovered and, when the lid is in the folded-down position, the outlet orifice is closed by the stoppering means.

15. The cap as in claim 1, wherein:

the base comprises an opening for the passage of a neck of the container;

the lid comprises stoppering means arranged to close off the neck of the container, in a sealed manner with respect to the internal volume of the container;

when the lid is in the open position, the neck of the container is uncovered, and when the lid is in the folded-down position, the neck of the container is closed by the stoppering means.

16. The cap as in claim 14, wherein the stoppering means is arranged for sealed closure, requiring antagonist energy in order to release the stoppering means.

17. The cap as in claim 16, wherein the stoppering means serve as means for locking the lid with respect to the base in the folded-down position.

18. The cap as in claim 16, wherein the mechanical energy stored is greater than the energy required to release the stoppering means and the means for locking the lid with respect to the base, plus the energy required to overcome the resistance to rotation of the articulation means.

19. The cap as in claim 1, wherein means for slowing the rotational return travel of the lid from its open position to the folded-down position is formed between the base and the lid.

20. The cap as in claim 19, wherein the slowing means comprises, on the side of one of the lid and the base, a stop tooth and, in register with the stop tooth, on the side of one of the lid and the base not having the stop tooth, a serrated annulus about the axis of rotation of the hinge, the serrations of which escape from the stop tooth in the direction of opening of the lid from the folded-down position, and the serrations of which mesh flexibly with the stop tooth in the direction of return of the lid from the open position to the folded-down position.

21. The cap as in claim 1, wherein the hinge comprises at least one element connecting the base and the lid, formed integrally with the lid and the base, arranged sufficiently thin, to allow a rotational movement of the lid from the folded-down position to the open position, with a limited intrinsic resistance to rotation.

22. The cap as in claim 1, wherein the lid and the base are two separate parts, connected to one another freely in rotation by the articulation means.

23. The cap as in claim 22, wherein the hinge is composed, of at least two female elements arranged along the axis of rotation, belonging to one of the lid and the base and at least two complementary male elements, mounted to rotate freely in the two female elements respectively, arranged along the axis of rotation, belonging to one of the base and the lid not having the female elements.

24. The cap as in claim 23, wherein the two male elements and the two female elements of the hinge comprise means allowing them to be wedged in by simple pressure of the lid with respect to the base, the lid and the base being arranged parallel one above the other.

25. The cap as in claim 23, wherein on one side, the lid comprises a barrel provided with two pegs opposed along an axis of the barrel, forming the two male elements of the hinge;

the base comprises a cradle for accepting the barrel such that the barrel can rotate freely, on each side of the cradle, the two lugs comprising a set of housings for accepting the two pegs such that the pegs can rotate freely, and forming the two female elements of the hinge.

26. The cap as in claim 24, wherein at least one of the two pegs and the two lugs comprises means, for allowing clip-fastening by simple pressure of the lid on the base.

27. The cap as in claim 23, wherein, the lid on one side comprises a barrel provided with at least two housings, arranged along an axis of the barrel, forming the two female elements of the hinge and, on the other side, the base comprises at least two lugs comprising two pegs fitting with freedom to rotate into the two housings respectively, forming the two male elements of the hinge.

28. The cap as in claim 24, wherein at least one of the two pegs and the two ends of the barrel comprises means for allowing the two pegs to be clip-fastened into the two housings respectively, by simple pressure of the lid on the base.

29. A container comprising:

a cap configured to be mounted on a container having an internal volume, the cap comprising:

a base comprising means for mounting the cap on the container;

a lid;

means for articulating the lid with respect to the base, between an open position and a folded-down position, defining an axis of rotation about which the lid can rotate;

locking means for locking the lid with respect to the base in the folded-down position;

unlocking means for unlocking the lid with respect to the base, which is antagonist to the locking means, arranged to be actuated manually, and movable to a final position at which the unlocking means triggers the lid to move toward the open position;

wherein the articulation means is arranged to allow the lid to be propelled in rotation by a mechanical energy stored in at least one of the base and the lid due to deformation of at least one of the base and the lid toward the open position;

the lid and the base are arranged to, in locked position elastically resist relative rotational movement between the lid and the base, and correspondingly store the mechanical energy through deformation of at least one of the base and the lid, the mechanical energy stored during deformation being enough to propel the lid in rotation toward the open position; and the unlocking means is arranged in the form of a detent, which when moved to the final position unlocks the locking means, causing movement of the lid relative to the base. the stored mechanical energy caused by the deformation being released propelling the lid in rotation toward the open position, wherein the cap is arranged on the neck of the container.

30. The container as in claim 29, the internal volume of which is filled with a liquid.

* * * * *